United States Patent [19]

Marino et al.

[11] Patent Number: 4,640,427

[45] Date of Patent: Feb. 3, 1987

[54] TAMPER-RESISTANT CLOSURE

[76] Inventors: Michael Marino, 540 Sampson St., New Castle, Pa. 16101; Thomas C. Rudis, 2306 Eastman, Rolling Meadows, Ill. 60008

[21] Appl. No.: 804,498

[22] Filed: Dec. 4, 1985

[51] Int. Cl.[4] ..... B65D 41/34

[52] U.S. Cl. ..... 215/232; 215/252; 215/253; 156/69; 156/272.8

[58] Field of Search ..... 215/232, 252, 253, 277, 215/278; 220/359, 214, 266; 156/272.8, 69

[56] References Cited

U.S. PATENT DOCUMENTS

| | | | |
|---|---|---|---|
| 958,887 | 5/1910 | Parmele | 215/252 |
| 2,213,932 | 9/1940 | Rehfeld | 215/278 X |
| 2,390,291 | 12/1945 | Blackman | 215/252 |
| 3,253,729 | 5/1966 | Virany | 215/253 X |
| 3,560,291 | 2/1971 | Foglia et al. | 156/272.8 X |
| 3,920,503 | 11/1975 | Keeler | 215/232 X |
| 3,983,645 | 10/1976 | Rycroft | 215/232 X |
| 4,197,955 | 4/1980 | Luenser | 215/232 X |

*Primary Examiner*—Donald F. Norton
*Attorney, Agent, or Firm*—Harpman & Harpman

[57] ABSTRACT

A tamper-resistant closure for containers such as bottles of varying sizes for various products wherein the closure has a continuous thread pattern engageable on a matching continuous thread pattern on the container or alternately a snap-on fastening configuration, provides a depending tab having a frangible area transversally thereof formed integrally with the closure and extending alongside a portion of the container. An area of the depending tab is secured to the container by fusing or melting the materials so as to bond the same together preferably by the action of a laser using the natural oscillations of atoms or molecules between energy levels for generating coherent electromagnetic radiation in the ultraviolet, visible or infrared regions of the spectrum of sufficient intensity and duration to achieve the desired bonding of the closure and the container when the same are formed of molded thermoplastic material.

4 Claims, 4 Drawing Figures

TAMPER-RESISTANT CLOSURE

BACKGROUND OF THE INVENTION

1. Technical Field

This invention relates to plastic cap and container articles incorporating tamper-resistant and tamper-indicating constructions.

2. Description of the Prior Art

Prior devices of this type have generally formed the closures with means frictionally engaging the containers incorporating manually detachable fastening configurations such as disclosed in U.S. Pat. Nos. 4,066,182, 4,162,736 and 4,202,455. Still other prior art structures have placed paper or paper-like bands across a closure and secured the ends of the band to the container. The present invention forms the container and the closure which can be either a continuous thread engagement type or a snap-on resilient configuration with a depending tab on the closure positioned alongside and engaging the container wall. The depending tab having a thin walled frangible area transversely thereof adjacent the closure and provides that the depending tab of the closure be bonded to the wall of the container after the container has been filled with the desired product and the closure applied thereto. The bonding is accomplished by alining the depending tab with a laser and momentarily directing radiant energy against the tab and the underlying wall of the container sufficient to fuse or partially melt the same and form a permanent bond whereby the closure cannot be removed from the container without separating the same from the bonded depending tab.

SUMMARY OF THE INVENTION

In the present invention a molded plastic closure for a container has a depending tab positioned alongside the container, the tab having a frangible line transversely thereof is bonded to the container below the frangible line by fusing or partially melting a limited area of the depending tab and the container wall by momentarily applied radiant energy from a laser. The closure cannot be removed from the container without breaking the depending tab at the transverse tear line whereby the closure is sealed to the container in closed position and resists tampering of the contents and indicates such tampering by the separation of the depending tab at the transverse tear line when the closure is removed from the container.

DESCRIPTION OF THE PREFERRED EMBODIMENT

Figure 1:
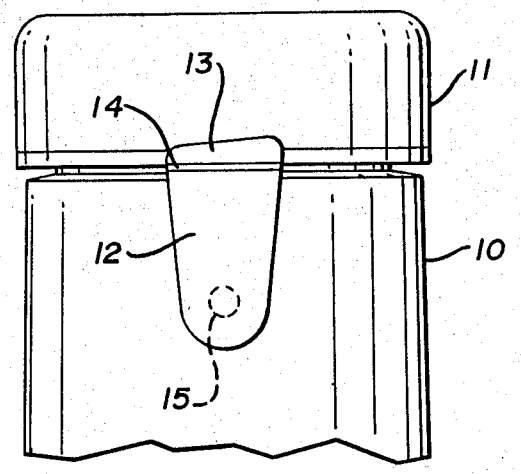
FIG. 1 is a side elevation of the tamper-resistant closure showing the same on a container with parts broken away. Broken lines indicate the area of the closure fused and bonded to the container.
Figure 2:
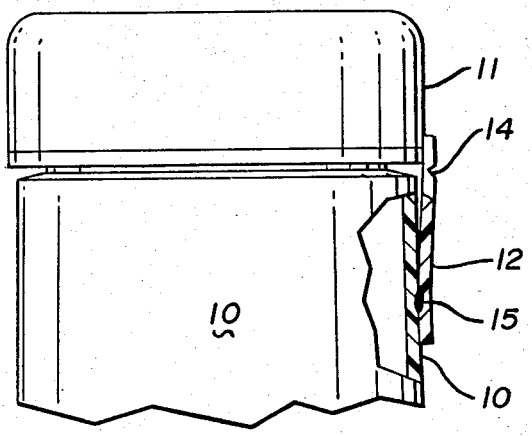
FIG. 2 is a side elevation of the closure and container of FIG. 1 partially rotated and having parts broken away and parts in cross section.
Figure 3:
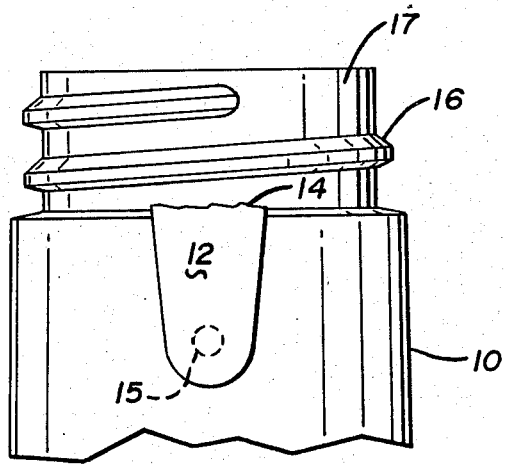
FIG. 3 is a side elevation of the container seen in FIGS. 1 and 2 and showing the closure removed.

Referring to the drawings and FIG. 1 in particular, it will be seen that a portion of a container 10 is provided with a closure 11 the closure 11 having a depending tab 12 integrally formed with the closure 11 and extending outwardly therefrom at an upper end 13 and downwardly alongside the container 10. A transverse tear line 14 takes the form of a thin frangible wall and broken lines arranged in a circle on a lower portion of the depending tab 12 indicate a fused or partially melted area 15 forming a permanent bond between the inner surface of the depending tab 12 and the outer surface of the container 10. By referring to FIG. 2 of the drawings a cross sectional detail of the depending tab 12 and a portion of the wall of the container 10 may be seen and the fused or partially melted bonded area 15 is illustrated as being formed in the adjacent meeting surfaces of the depending tab 12 and the wall of the container 10. By referring to FIG. 3 of the drawings, the container 10 is illustrated with the closure removed therefrom and the major portion of the depending tab 12 being separated from the closure and remaining affixed to the container 10 by the bonded area 15. In FIG. 3 of the drawings, a continuous thread pattern 16 is illustrated as formed on a neck 17 of the container 10 the neck being of a smaller diameter than the container and it will be understood by those skilled in the art that the closure 11 hereinbefore referred to and illustrated in FIGS. 1 and 2 of the drawings has a matching continuous thread pattern therein whereby it may be rotated in a clockwise direction to be secured to the container in closed relation and rotated in a counter clockwise direction to be removed from the container which latter action requires that the depending tab 12 and the major portion thereof permanently bonded to the container 10 be torn as on the tear line 14 thereby leaving the major portion of the separated depending tab 12 affixed to the container 10 as seen in FIG. 3 of the drawings.

Figure 4:
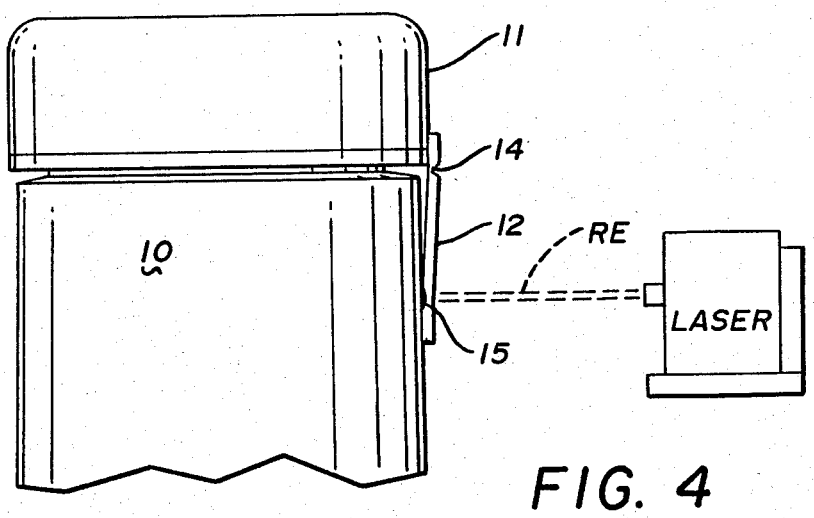
FIG. 4 is a side elevation of a closure and container with parts broken away and illustrating a laser with broken lines indicating radiant energy fusing a portion of the closure to the container.

By referring to FIG. 4 of the drawings the closure 11 is illustrated on the container 10 with the integrally formed depending tab 12 extending downwardly alongside and engaging the container 10 with the bonded area 15 being indicated and illustrated as being formed by a beam of radiant energy RE as directed thereagainst by a LASER.

The LASER comprises a coherent light source using a crystalline solid, such as a ruby, liquid or gas-discharge tube, in which atoms are pumped simultaneously into excited states by an incoherent light flash. The atoms return to their ground state with the emission of a light pulse for which the energy flux may be 10 $mW/cm^2$ (lasting 30 nanosecs) and the beam divergence $10^{-2}$ radians. The radiant energy resulting from the light pulse directed by the LASER against the depending tab 12 which is in contacting relation with the wall of the container 10 is sufficient to fuse or partially melt the thermoplastic material of the container 10 and the closure 11 and depending tab 12 and instantly bond the two together permanently.

It will be seen that the depending tab 12 which is integrally formed with the closure 11 and provided with the transverse tear line 14 is so formed that a force which is larger than ordinary handling forces is required to move the closure 11 and the depending tab 12 sufficiently to tear the depending tab 12 from the closure 11 and thereby positively insure the indication of tampering with the closure 11.

It will thus be seen that the invention set forth in the preceding description provides a simple and inexpensive tamper-resistant closure for a container which positively indicates tampering or removal of the closure and the closure with its depending tab attachment to the container being easily assembled and bonded on existing container filling and closing equipment. A modification of the invention comprises bonding the depending tab 12 of the closure to the container 10 with an alkyl 2-cyanoacrylates adhesive, applied to either the container 10 or the depending tab 12 of the closure 11 just before or when the depending tab 12 is positioned in its final location against the container 10, so as to bond a portion thereof below the transverse tear line 14 to the container 10.

Although preferred embodiments of the present invention have been described it will be understood that various changes may be made within the scope of the appended claims.

Having thus described our invention, what we claim is:

1. An improvement in a thermoplastic tamper-resistant closure for a thermoplastic cylindrical container of the type having a neck surrounding an opening to the container and having a closure retaining continuous thread pattern on said neck, said closure comprising means for covering said opening to said container and having an annular portion with inner and outer surfaces surrounding said neck, a continuous thread pattern in said inner surface of said annular portion of said closure for cooperation with said continuous thread pattern on said neck, the improvement wherein an integral depending tab is located on the outer surface of said annular portion of said closure and positioned alongside of said cylindrical container, a transverse tear line in said depending tab adjacent said annular portion of said closure defining a tear-away portion of said depending tab therebelow, an area of said tear-away portion and a matching area of said cylindrical container being bonded to one another whereby separation of said depending tab at said tear line leaves a small portion of said depending tab on said annular portion of said closure spaced with respect to said tear-away portion so that said closure can be rotated freely to remove the same from said neck of said container.

2. The improvement in a closure for a container set forth in claim 1 and wherein said area of the tear-away portion of the depending tab and the matching area of said container are fused and partially melted and thereby bonded to said container by heat generated therein by a laser.

3. The improvement in a closure for a container set forth in claim 1 and wherein said area of the tear-away portion of the depending tab and the matching area of said container are bonded to one another with an alkyl 2-cyanoacrylates adhesive.

4. The method of bonding a portion of an offset depending tab of a rotatable closure to a container on which said closure is threadably positioned comprising forming said closure to locate said depending tab against a side of said container, directing electromagnetic radiation of sufficient intensity and duration against an area of said depending tab so as to fasten a portion of said depending tab to said container and forming a tear line in said depending tab adjacent said closure.

* * * * *